US011742169B2

(12) United States Patent
Gottschalk et al.

(10) Patent No.: US 11,742,169 B2
(45) Date of Patent: Aug. 29, 2023

(54) ULTRA-FAST MOVING CONDUCTOR WITH REMOVABLE CORE PIN

(71) Applicant: EATON INTELLIGENT POWER LIMITED, Dublin (IE)

(72) Inventors: Andrew L. Gottschalk, Monaca, PA (US); Robert Michael Slepian, Murrysville, PA (US); Ganesh Kumar Balasubramanian, Horseheads, NY (US); Andrew Deutsch, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/551,328

(22) Filed: Dec. 15, 2021

(65) Prior Publication Data

US 2023/0187157 A1 Jun. 15, 2023

(51) Int. Cl.
*H01H 71/34* (2006.01)
*H01H 1/02* (2006.01)

(52) U.S. Cl.
CPC ..... *H01H 71/345* (2013.01); *H01H 1/0206* (2013.01); *H01H 2001/0205* (2013.01)

(58) Field of Classification Search
CPC ..... H01H 71/345; H01H 1/0206; H01H 2001/0205
See application file for complete search history.

(56) References Cited

U.S. PATENT DOCUMENTS 3,191,276 A * 6/1965 Gwyn, Jr. ..... B21K 1/62 228/115
3,996,439 A * 12/1976 Tokuyama ..... H01H 33/91 218/62
4,079,217 A 3/1978 Oeschger
(Continued)

FOREIGN PATENT DOCUMENTS

DE 10 2013 106 727 A1 12/2014

OTHER PUBLICATIONS

European Patent Office, "International Search Report and Written Opinion", for corresponding International PCT Patent Application No. PCT/EP2022/025567, dated Mar. 14, 2023, 15 pp.

*Primary Examiner* — Bernard Rojas
(74) *Attorney, Agent, or Firm* — Eckert Seamans Cherin & Mellott, LLC

(57) ABSTRACT

An ultra-fast moving conductor for use with a circuit breaker is provided. The moving conductor includes a hollow outer stem and a removable core. Multiple removable cores are produced for use with the moving conductor for different purposes. The outer stem is produced from annealed copper that must be brazed before the circuit breaker is placed into operation, and a first removable core produced from copper is inserted into the outer stem to provide structural reinforcement to the outer stem during brazing. After brazing is complete, the copper core is removed from the outer stem, and a significantly lighter work hardened aluminum core is inserted into the outer stem. The lightweight aluminum core enables the moving conductor to open the circuit breaker
(Continued)

much faster than the copper core would, and the copper core prevents contamination of the brazing furnace that would result from using the aluminum core during brazing.

18 Claims, 4 Drawing Sheets

(56) References Cited

U.S. PATENT DOCUMENTS

| | | | | |
|---|---|---|---|---|
| 4,152,560 | A * | 5/1979 | McCloud | H01H 1/385 200/243 |
| 4,272,661 | A | 6/1981 | Dethlefsen | |
| 4,568,804 | A * | 2/1986 | Luehring | H01H 33/66207 200/308 |
| 5,638,038 | A * | 6/1997 | Suzuki | H01H 71/405 335/35 |
| 10,969,031 | B2 * | 4/2021 | Xu | F16K 1/32 |
| 2021/0012992 | A1 | 1/2021 | Nojima et al. | |
| 2021/0183599 | A1 * | 6/2021 | Goehler | H01H 33/02 |

* cited by examiner

ULTRA-FAST MOVING CONDUCTOR WITH REMOVABLE CORE PIN

FIELD OF THE INVENTION

The disclosed concept relates generally to circuit interrupters, and in particular, to movable contact assemblies used in circuit interrupters.

BACKGROUND OF THE INVENTION

Circuit interrupters, such as for example and without limitation, circuit breakers, are typically used to protect electrical circuitry from damage due to an overcurrent condition, such as an overload condition, a short circuit, or another fault condition, such as an arc fault or a ground fault. Circuit interrupters typically include separable electrical contacts, which operate as a switch. When the separable contacts are in contact with one another in a closed state, current is able to flow through any circuits connected to the circuit interrupter. When the separable contacts are isolated from one another in an open state, current is prevented from flowing through any circuits connected to the circuit interrupter. Typically, such circuit interrupters include an operating mechanism designed to rapidly close or open the separable contacts, and a trip mechanism, such as a trip unit, which senses a number of fault conditions to trip the separable contacts open automatically by actuating the operating mechanism. Upon sensing a fault condition, the trip unit trips the operating mechanism to move the separable contacts to their open position.

Some circuit interrupters such as, for example, power circuit breakers, employ vacuum interrupters as the switching devices. The separable electrical contacts usually included in vacuum interrupters are generally disposed on the ends of corresponding electrodes within an insulating housing that forms a vacuum chamber. Typically, one of the contacts is fixed relative to both the housing and to an external electrical conductor, which is electrically interconnected with a power circuit associated with the vacuum interrupter. The other contact is part of a movable contact assembly including an electrode stem and a contact disposed on one end of the electrode stem and enclosed within the vacuum chamber. A driving mechanism is disposed on the other end of the moving electrode stem, external to the vacuum chamber. When the trip unit detects a fault condition, the trip unit actuates the operating mechanism to cause the driving mechanism to open the separable contacts within the vacuum chamber. After the fault condition has resolved, the trip unit signals the actuator to cause the driving mechanism to drive the separable contacts closed within the vacuum chamber.

The operating mechanism of a circuit interrupter needs to be capable of driving the separable contacts open quickly in order to mitigate the effects of a fault condition. The efficacy of hybrid circuit interrupters in particular requires very fast opening of the mechanical separable contacts, as hybrid circuit interrupters use electronics to commutate current after the mechanical separable contacts are opened in order to reduce arcing, and the minimization of arcing depends on minimizing opening time. However, the force required to open mechanical separable contacts quickly can be significant due to the mass of the movable contact assembly that must be moved in order to open the separable contacts.

There is thus room for improvement in movable contact assemblies in circuit interrupters.

SUMMARY OF THE INVENTION

These needs, and others, are met by systems and methods for producing a moving conductor structured to open at ultra-fast speeds during operation of a circuit interrupter. The moving conductor includes a hollow outer stem and a removable core. Multiple removable cores are produced for use with the moving conductor, with a first removable core being produced from braze-compatible metal for insertion within the outer stem during production of the outer stem, and a second removable core being produced from ultra-lightweight metal for insertion within the outer stem during operation of the circuit interrupter. The outer stem is produced from annealed metal that must be brazed before the circuit breaker is placed into operation, and the first removable core produced from braze-compatible metal is inserted into the outer stem to provide structural reinforcement to the outer stem during brazing. After brazing is complete, the first removable core is removed from the outer stem, and the significantly lighter second removable core is inserted into the outer stem.

In accordance with one aspect of the disclosed concept, a moving conductor for use in a circuit interrupter includes: a moving separable contact, a hollow outer stem, and an operating core inserted into the outer stem and structured to be used when the circuit interrupter is put into operation to regulate power flow between a power source and a load. The removable core is further structured to be removed from the outer stem.

In accordance with another aspect of the disclosed concept, a circuit interrupter includes: a line side structured to electrically connect to a power source, a load side structured to electrically connect to a load, a stationary conductor comprising a stationary separable contact, a moving conductor comprising a moving separable contact, an operating mechanism structured to actuate the moving conductor in order to open and close the stationary and movable separable contacts, and an electronic trip unit structured to actuate the operating mechanism. The moving conductor further includes a hollow outer stem, as well as an operating core inserted into the outer stem and structured to be used when the circuit interrupter is put into operation to regulate power flow between the power source and the load. The stationary and moving separable contacts are electrically connected between the line side and the load side, and the operating core is structured to be removed from the outer stem.

In accordance with a further aspect of the disclosed concept, a method of producing a movable conductor for use with a circuit interrupter includes: producing a hollow outer stem from copper, producing a work hardened aluminum core structured to be inserted into the outer stem, and inserting the aluminum core into the outer stem prior to putting the circuit interrupter into operation to regulate power flow between a power source and a load.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
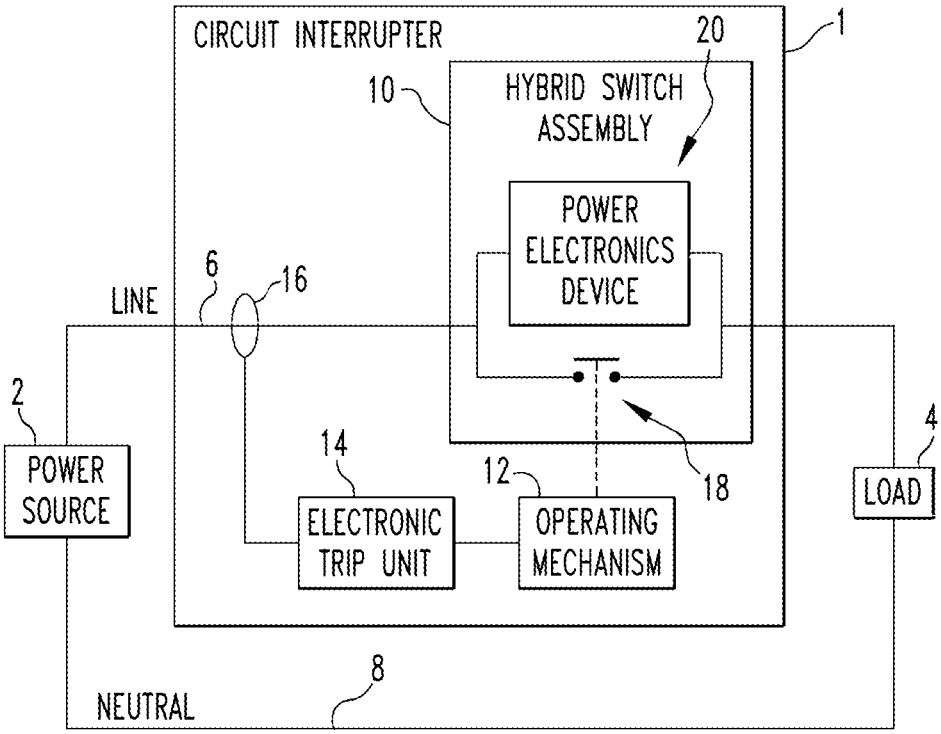
FIG. 1 is a schematic diagram of a hybrid circuit interrupter, in accordance with an example embodiment of the disclosed concept.

As used herein, the singular form of "a", "an", and "the" include plural references unless the context clearly dictates otherwise.

As used herein, the term "number" shall mean one or an integer greater than one (i.e., a plurality).

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

FIG. 1 is a schematic diagram of a circuit interrupter 1 (e.g., without limitation, a circuit breaker), in accordance with an example embodiment of the disclosed concept. The circuit interrupter 1 is structured to be electrically connected between a power source 2 and a load 4 via LINE and NEUTRAL conductors 6,8. The circuit interrupter 1 is structured to trip open or switch open to interrupt current flowing between the power source 2 and load 4 in the event of a fault condition (e.g., without limitation, an overcurrent condition) to protect the load 4, circuitry associated with the load 4, as well as the power source 2.

The circuit interrupter 1 is more specifically a hybrid circuit interrupter or ultra-fast switch that includes a hybrid switch assembly 10, an operating mechanism 12, and an electronic trip unit 14. The electronic trip unit 14 is structured to monitor power flowing through the circuit interrupter 1 via a current sensor 16 and/or other sensors and to detect fault conditions based on the power flowing through the circuit interrupter 1. In response to detecting a fault condition, the electronic trip unit 14 is structured to output a signal to the operating mechanism 12 to initiate a trip. The operating mechanism 12 is structured to cause the hybrid switch assembly 10 to open a set of mechanical separable contacts 18 in the hybrid switch assembly 10 in order to interrupt current flowing through the circuit interrupter 1 in response to the signal from the electronic trip unit 14.

The hybrid switch assembly 10 in FIG. 1 is a simplified depiction of a hybrid switch assembly intended to explain how current commutates past mechanical separable contacts in a hybrid switch, and is not intended to be limiting on the different types of hybrid switch assemblies that can be included in circuit interrupter 1. Hybrid switch assembly 10 includes a pair of separable mechanical contacts 18. When the separable contacts 18 are in a closed state such that they are in contact with one another, current flows through the LINE conductor 6 and the separable contacts 18 to the load 4. When electronic trip unit 14 outputs a signal to the operating mechanism 12 to initiate a trip, the operating mechanism 12 actuates to physically separate the separable contacts 18. The power electronics device 20 is configured to turn on as the separable contacts 18 open, i.e. separate. When the power electronics device 20 is turned on, current is able to commutate past the open separable contacts 18 by flowing through the LINE conductor 6 and the power electronics device 20. The power electronics device is configured to remain powered on only for a very short time such that the LINE connection between the power source 2 and the load 4 is broken shortly after the current is commutated. By enabling current to commutate past the separable contacts 18 through power electronic device 20 for a very limited time before the connection between the power source 2 and load 4 is completely opened, the effects of arcing are reduced.

Figure 2A:
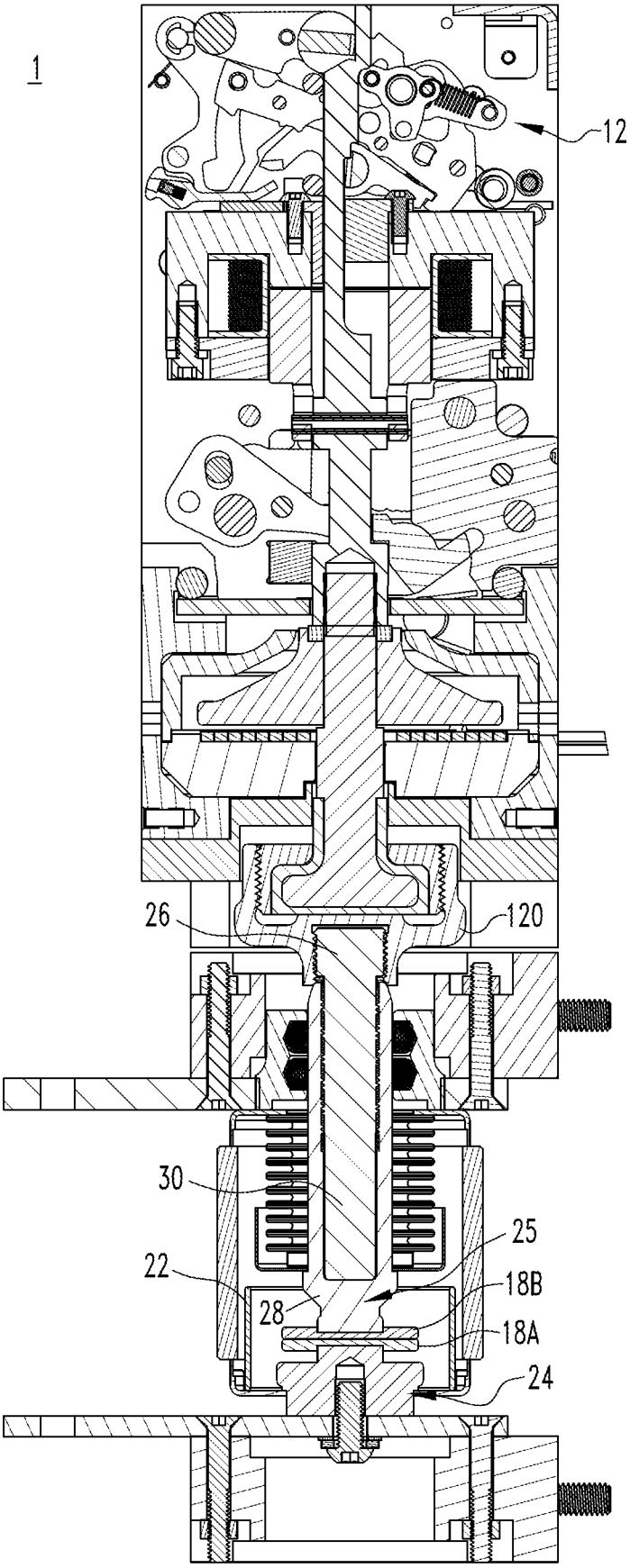
FIG. 2A is a sectional view of the circuit interrupter schematically depicted in FIG. 1, showing how the separable contacts schematically depicted in FIG. 1 are enclosed in a vacuum housing and coupled to a stationary conductor and a moving conductor, with the sectional view of the moving conductor being taken along the line 2-2 shown in FIG. 3, in accordance with an example embodiment of the disclosed concept.
Figure 2B:
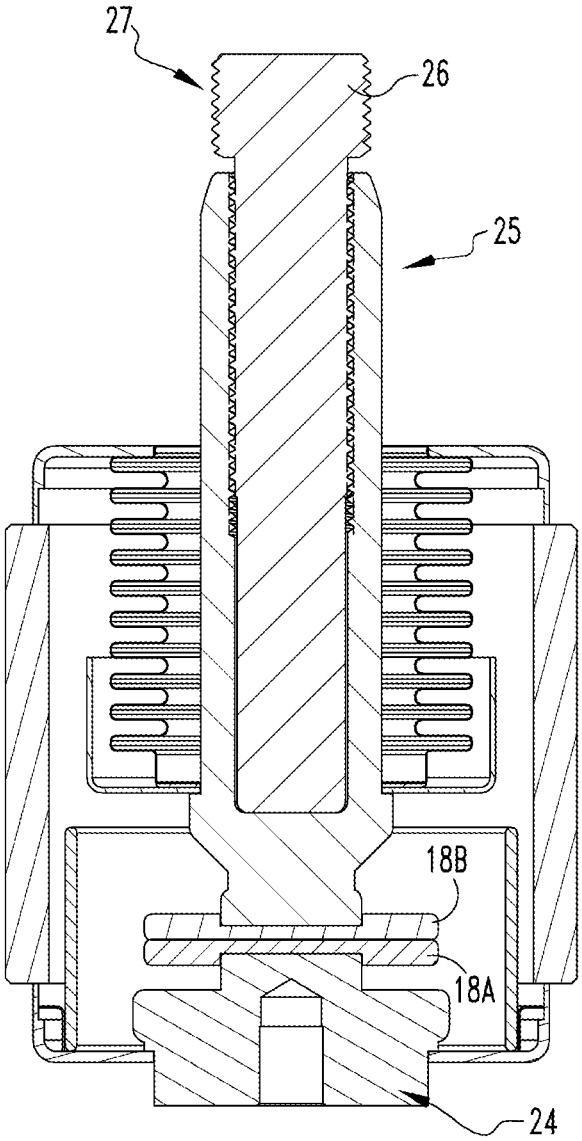
FIG. 2B shows a portion of the arrangement shown in FIG. 2A, including the separable contacts, stationary conductor, moving conductor, and vacuum housing, in order to better show various details of these components, in accordance with example embodiments of the disclosed concept.
Figure 2C:
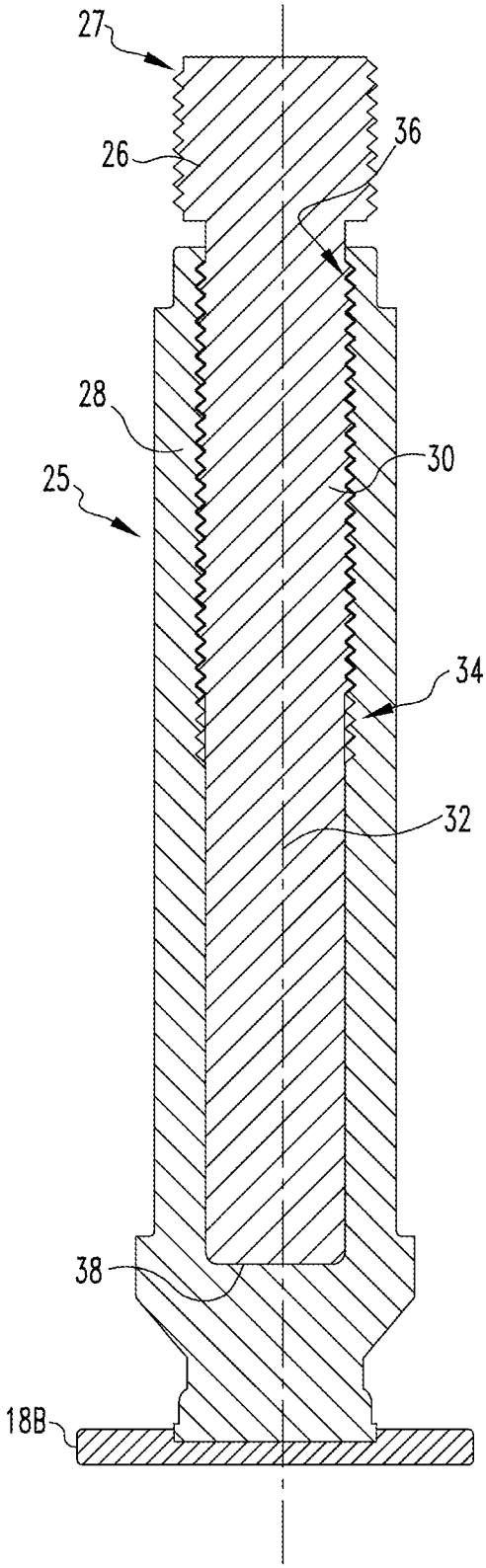
FIG. 2C shows the moving conductor shown in FIGS. 2A and 2B in isolation in order to better show certain details of the moving conductor, in accordance with example embodiments of the disclosed concept.

Referring now to FIG. 2A, a sectional view of the circuit interrupter 1 schematically depicted in FIG. 1 is shown. FIG. 2B is an enlarged view of a portion of the arrangement shown in FIG. 2A and is included to better show certain details of selected components from FIG. 2A. In an exemplary embodiment of the disclosed concept, the circuit interrupter 1 is a vacuum circuit interrupter, and FIGS. 2A and 2B show a sectional view of the separable contacts 18 enclosed within a vacuum housing 22. Stationary separable contact 18A forms one end of a stationary conductor 24 and moving separable contact 18B forms one end of a moving conductor 25. Stationary separable contact 18A and moving separable contact 18B are referred to collectively herein as the separable contacts 18. It will be appreciated that the stationary conductor 24 remains stationary relative to the vacuum housing 22, and that when reference is made herein to opening and closing the separable contacts 18, the opening and closing is achieved by actuation of the moving conductor 25 by the operating mechanism 12 (shown in FIG. 2A). FIG. 2C shows the moving conductor 25 alone, in order to better show certain details of the moving conductor 25. The sectional view of moving conductor 25 shown in FIGS. 2A, 2B, and 2C is taken along the line 2-2 shown in FIG. 3.

In FIG. 2A, a core 30 of the moving conductor 25 (the core 30 being described further herein below) comprises an isolation end 26 disposed opposite the end of core 30 that is proximate to moving separable contact 18B. The isolation end 26 of core 30 is coupled to the operating mechanism 12 via an isolation coupling 120. The isolation end 26 of core 30 is structured to be coupled to the isolation coupling 120 via a plurality of threads 27 formed on isolation end 26 (which can be most clearly viewed in FIGS. 2B and 2C).

Figure 3:
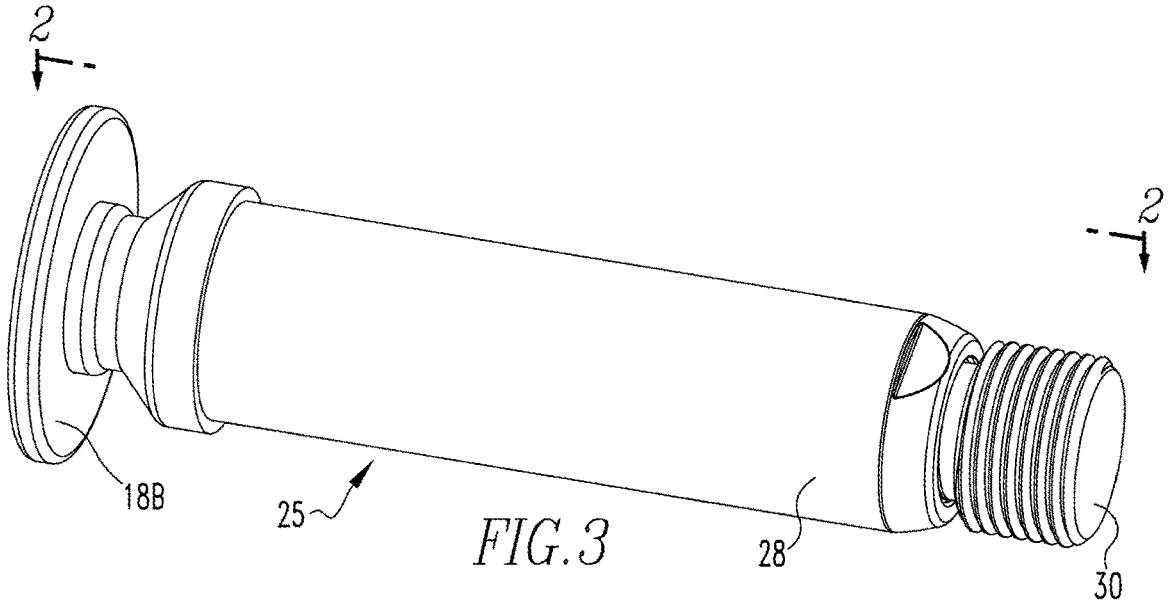
FIG. 3 is an isometric external view of the moving conductor shown in FIGS. 2A and 2B.

Referring now to FIG. 3 (which shows an isometric external view of the moving conductor 25) in addition to FIGS. 2A-2C, the moving conductor 25 comprises a conductive outer stem 28 and a conductive removable core 30. In viewing FIG. 3, it will be appreciated that outer stem 28 and core 30 are substantially cylindrical such that a cross section of either outer stem 28 or core 30 viewed in a plane orthogonal to the longitudinal axis 32 (shown in FIG. 2C) would appear substantially circular.

As most clearly shown in FIG. 2C, an interior surface of outer stem 28 is formed with a plurality of threads 34, and an exterior surface of removable core 30 is formed with a plurality of threads 36 corresponding to threads 34 that enable removable core 30 to be screwed into and out of outer stem 28 when sufficient torque is applied. Core 30 and outer stem 28 are structured to enable core 30 to fit snugly within outer stem 28, such that the external surface of core 30 abuts against the inner diameter, i.e. interior surface, of outer stem 28. This snug insertion results in an insertion end 38 (labeled in FIG. 2C) of the core 30 disposed opposite the isolation end 26 to abut a portion of the interior surface of outer stem 28 disposed proximate to separable contact 18B. These two aspects of the moving conductor 25, i.e. the removable core design and the snug fit of the removable core 30 within the outer stem 28, are notable aspects of the disclosed concept. As described further herein below, the removable core design enables any given interchangeable core 30 (for example and without limitation, a first core 30 produced from copper) to be removed from outer stem 28 so that a different interchangeable core 30 (for example and without limitation, a second core 30 produced from aluminum) can instead be inserted into outer stem 28. The snug fit of a given interchangeable core 30 within the outer stem 28 maximizes the structural strength of the moving conductor 25 so that the moving conductor 25 can withstand the high forces experienced during opening and closing of the separable contacts 18.

Hybrid circuit interrupters or ultra-fast switches are used when ultra-fast opening speed of separable contacts is desired, and it will be appreciated that reducing the mass of moving conductor 25, and thereby reducing the force required to open the moving conductor 25, is one way to increase opening speed. The opening speed greatly affects the speed with which current flowing through circuit interrupter 1 can be commutated to the power electronics device 20 when the mechanical separable contacts 18 are opened, as detailed previously herein in connection with FIG. 1. There is thus great incentive to minimize the mass of the moving conductor 25.

Copper is one of the preferred materials from which to produce moving conductors of circuit interrupters. While copper is desirable for its electrical properties, it is a relatively high mass material that results in moving conductors having relatively slow opening speeds. A copper moving conductor such as moving conductor 25 is generally produced from annealed copper, however, moving separable contacts such as moving separable contact 18B are generally produced from harder metals, for example and without limitation, tungsten. Accordingly, in exemplary embodiments of the disclosed concept, outer stem 28 is produced from copper while moving separable contact 18B is produced from tungsten, and outer stem 28 and separable contact 18B are brazed in order to fixedly couple moving contact 18B to outer stem 28. In addition to fixing moving separable contact 18B to outer stem 28, brazing provides the additional benefit of hardening the copper of outer stem 28 so that the moving conductor 25 can better withstand high forces produced during opening and closing of the separable contacts 18. Aluminum has a significantly lower mass than copper, and a moving conductor produced from a combination of copper and aluminum components would facilitate significantly faster opening of separable contacts than a moving conductor produced predominantly from copper, but it is well known in the relevant field that aluminum will contaminate a brazing surface due to the fact that aluminum has a high affinity for oxygen. Thus, a moving conductor that includes aluminum should not be brazed in a furnace, as only components produced from oxygen free materials should be brazed.

Figure 4:
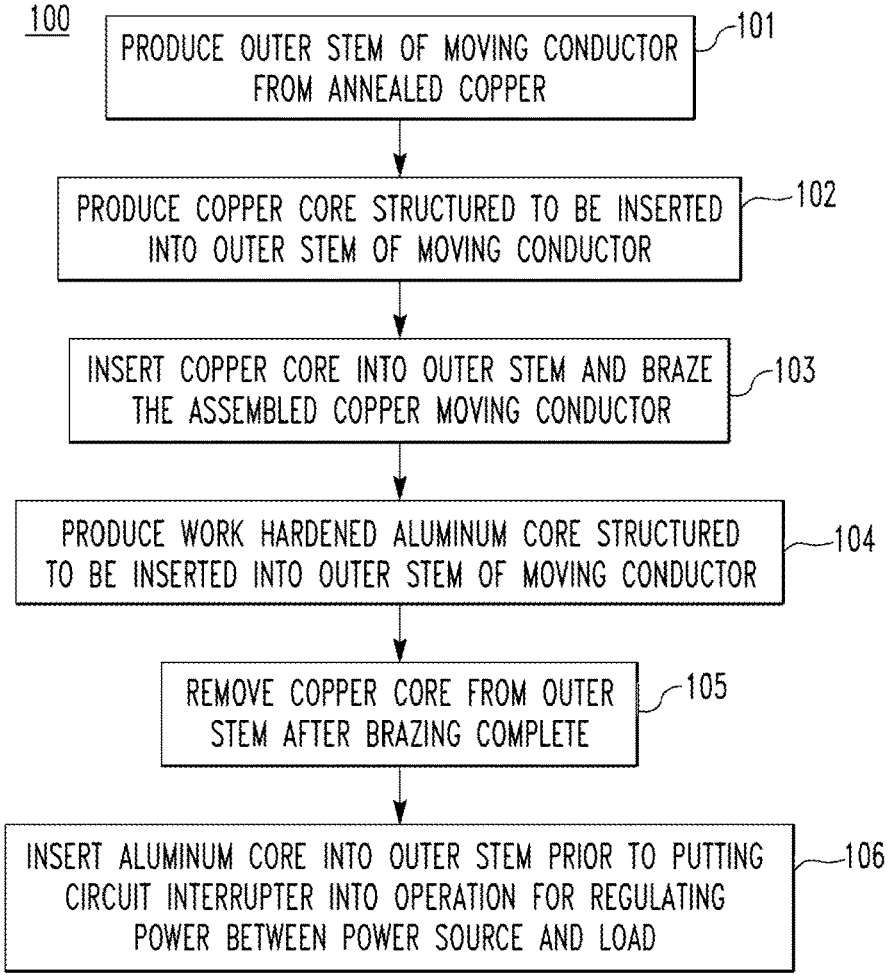
FIG. 4 is a flow chart of a method for producing a movable conductor for use with a circuit interrupter, in accordance with example embodiments of the disclosed concept.

In exemplary embodiments of the disclosed concept, the outer stem 28 is produced from copper due to the desirable electrical properties of copper. In order to address the limitations of a moving conductor 25 assembled only from copper components and the limitations of brazing aluminum discussed above, the systems and the methods disclosed herein provide for producing both a copper core 30 and a work-hardened aluminum core 30 that can be interchangeably inserted into the outer stem 28 for different purposes. Referring now to FIG. 4, a flowchart of a method 100 for producing a moving conductor 25 using both a copper core 30 and an aluminum core 30 is shown, in accordance with example embodiments of the disclosed concept. The method of FIG. 4 may be employed, for example, to produce the moving conductor 25 shown in FIGS. 2A-2C and FIG. 3. However, it will be appreciated that the method may be employed to produce other devices as well without departing from the scope of the disclosed concept.

The method begins at step 101 where the outer stem 28 is produced from annealed copper. It will be appreciated that it is preferable to braze the outer stem 28 with a core 30 inserted rather than brazing the hollow outer stem 28 alone in order to increase the stiffness of the outer stem 28 during brazing. Accordingly, at step 102 a copper core 30 is produced to provide structural support to the outer stem 28 during brazing, and at step 103, the copper core 30 is inserted into the outer stem 28 and the all-copper moving conductor 25 is brazed. At step 104, a work hardened aluminum core 30 is produced. At step 105, the copper core 30 is removed from the outer stem 28 after brazing is complete and replaced at step 106 with the aluminum core 30 in order to reduce the overall mass of moving conductor 25 and increase the opening speed during operation of the circuit interrupter 1. In an exemplary embodiment of the disclosed concept, the aluminum core 30 is produced from aluminum 7075, which is one of the strongest known aluminum alloys and is commonly used in aircraft construction due to its light weight and high durability. In the same exemplary embodiment, when the aluminum 7075 core 30 is fully inserted into outer stem 28 such that the insertion end 38 of core 30 abuts the interior surface of outer stem 28, there is 1,300 lbf of contact force between the insertion end 38 of core 30 and the interior surface of outer stem 28.

In sum, the copper core 30 enables the outer stem 28 to be properly brazed without compromising the integrity of the brazing furnace, and the aluminum core 30 facilitates significantly faster opening of the separable contacts 18 during operation of the circuit interrupter 1. The copper core 30 can alternatively be referred to as the production core 30, since it is only used in the moving conductor 25 during production, i.e. the brazing process. The aluminum core 30 can alternatively be referred to as the operating core 30, since it is only used in the moving conductor 25 when circuit interrupter 1 is in operation to regulate power between a power source 2 and a load 4. It will be appreciated that the methods disclosed herein are also applicable to moving conductor 25 components produced from materials other than copper and aluminum, and that the production core 30 can be produced from a material distinct from the material of outer stem 28 as long as the material of production core 30 is suitable for brazing.

It should be noted that brazing of the moving conductor 25 is important not only for ensuring that the overall structure of the moving conductor 25 is hardened enough to withstand opening and closing forces during operation of the circuit interrupter 1, but also because the threaded connection joint formed between the threads 34 of the outer stem 28 and threads 36 of the core 30 would otherwise stretch or fail due to the relatively soft nature of annealed copper. For example, the g-force experienced by a moving conductor 25 in a hybrid circuit interrupter 1 typically far exceeds 1,000 pounds. Accordingly, brazing the moving conductor 25 with the copper core 30 inserted before inserting the aluminum core 30 ensures that the threads 34 of outer stem 28 are as durable as possible in order to withstand high g-forces. In addition, it is generally desirable to maximize the number of threads 34,36 formed in the outer stem 28 and core 30 in order to spread the load and reduce the stress exerted on each individual thread during the torqueing process wherein the aluminum core 30 is tightened/screwed into the outer stem 28. It is expected that some of the threads 34,36 will deform during the torqueing process as the aluminum core 30 is screwed into the outer stem 28, and having several threads to share the assumed load ensures that the overall structural integrity of the fully assembled moving conductor 25 will be preserved after aluminum core 30 is completely torqued into outer stem 28.

In exemplary embodiments of the disclosed concept, outer stem 28 and core 30 are produced to have approximately 30 threads 34,36. However, outer stem 28 and core 30 can be produced to include more or fewer threads 34,36 without departing from the scope of the disclosed concept, as the number of threads 34,36 just needs to be high enough such that, when the aluminum core 30 and copper outer stem 28 are torqued together in their final positions, force can be applied to the relatively soft copper of outer stem 28 and slightly deform the relatively soft copper threads 34 until the high stresses of torqueing are reduced. The final positions of aluminum core 30 and copper outer stem 28 are those in which end 38 (labeled in FIG. 2C) of the core 30 abuts the interior surface of outer stem 28 (as previously detailed with respect to FIG. 2C), thus enabling moving conductor 25 to function optimally when circuit interrupter 1 is put into operation to regulate power flow between a power source 2 and a load 4.

Moving conductors 25 that have been produced in accordance with the disclosed concept clearly exhibit both the benefits of the oxygen free braze characteristics of the copper outer stem 28 as well as light weight and strength of the aluminum core 30. For example, during engineering testing of the disclosed concept, the weight of a particular moving conductor 25 assembled using an aluminum 7075 core 30 instead of a copper core 30 was reduced by nearly 25%, from 1.39 pounds to 1.05 pounds. A circuit interrupter 1 using the 1.05 pound moving conductor 25 is capable of opening the mechanical separable contacts 18 at a speed of at least 1 millimeter in 0.00025 seconds due to the significantly reduced mass of the moving conductor 25. In addition, the durability of the threads 27 and body of the isolation head 26 of the aluminum core 30 have resulted in the 1.05 pound moving conductor 25 having a 62,000 PSI yield, a more than ten-fold increase from the 6,000 PSI yield of a moving conductor 25 assembled only from annealed copper components.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. A moving conductor for use in a circuit interrupter, the moving conductor comprising:
- a moving separable contact;
- a hollow outer stem comprising an interior cavity; and
- an operating core inserted into the outer stem and structured to be used when the circuit interrupter is put into operation to regulate power flow between a power source and a load,
- wherein the operating core is structured to be removed from the outer stem, and
- wherein the operating core is structured to fill the entirety of the interior cavity.

2. The moving conductor of claim 1,
- wherein a set of stem threads are formed on an interior surface of the outer stem,
- wherein a set of core threads are formed on an exterior surface of the operating core, and
- wherein the outer stem and operating core are structured such that inserting the operating core into the outer stem comprises screwing the core threads along the stem threads in a first direction, and such that removing the operating core from the outer stem comprises screwing the core threads along the stem threads in a second direction opposite of the first direction.

3. The moving conductor of claim 1,
- wherein the moving conductor is structured to be produced by inserting a production core distinct from the operating core into the outer stem and keeping the production core inserted within the outer stem until production of the outer stem is complete,
- wherein the production core is produced from a first material, and
- wherein the operating core is produced from a second material distinct from the first material.

4. The moving conductor of claim 3,
- wherein the first material is copper,
- wherein the second material is an aluminum alloy,
- wherein the outer stem is produced from annealed copper, and
- wherein production of the outer stem is complete after the outer stem is brazed.

5. The moving conductor of claim 4,
- wherein the aluminum alloy is aluminum 7075.

6. The moving conductor of claim 3,
- wherein the production core and operating core are structured such that the weight of the moving conductor is reduced by over 20% when the operating core is inserted into the outer stem as compared to when the production core is inserted into the outer stem.

7. A circuit interrupter comprising:
- a line side structured to electrically connect to a power source;
- a load side structured to electrically connect to a load;
- a stationary conductor comprising a stationary separable contact;
- a moving conductor, the moving conductor comprising:
  - a moving separable contact;
  - a hollow outer stem comprising an interior cavity; and
  - an operating core inserted into the outer stem and structured to be used when the circuit interrupter is put into operation to regulate power flow between the power source and the load;

an operating mechanism structured to actuate the moving conductor in order to open and close the stationary and movable separable contacts; and an electronic trip unit structured to actuate the operating mechanism, wherein the stationary and moving separable contacts are electrically connected between the line side and the load side, wherein the operating core is structured to be removed from the outer stem, and wherein the operating core is structured to fill the entirety of the interior cavity.

8. The circuit interrupter of claim 7, further comprising:

a vacuum housing, wherein the stationary conductor is fixed relative to the vacuum housing and the stationary contact is disposed within the vacuum housing, and wherein the moving conductor is structured to move relative to the vacuum housing such that the movable separable contact always remains within the housing.

9. The circuit interrupter of claim 7, wherein the moving conductor is structured to be produced by inserting a production core distinct from the operating core into the outer stem and keeping the production core inserted within the outer stem until production of the outer stem is complete, wherein the production core is produced from a first material, and wherein the operating core is produced from a second material distinct from the first material.

10. The circuit interrupter of claim 9, wherein the first material is copper, wherein the second material is an aluminum alloy, wherein the outer stem is produced from annealed copper, and wherein production of the outer stem is complete after the outer stem is brazed.

11. The circuit interrupter of claim 10, wherein the aluminum alloy is aluminum 7075.

12. The circuit interrupter of claim 9, wherein the production core and operating core are structured such that the weight of the moving conductor is reduced by over 20% when the operating core is inserted into the outer stem as compared to when the production core is inserted into the outer stem.

13. The circuit interrupter of claim 7, further comprising:

a power electronics device electrically connected between the line side and the load side in parallel with the stationary and moving separable contacts, wherein, upon opening of the stationary and moving separable contacts, the power electronics device is structured to commutate current past the stationary and moving separable contacts.

14. The circuit interrupter of claim 13, wherein the moving conductor is structured to open a distance of at least one millimeter within 0.00025 seconds.

15. A method of producing a movable conductor for use with a circuit interrupter, the method comprising:

producing, from copper, a hollow outer stem comprising an interior cavity;

producing a work hardened aluminum core structured to be inserted into the outer stem so as to fill the entirety of the interior cavity and structured to be removed from the outer stem; and inserting the aluminum core into the outer stem prior to putting the circuit interrupter into operation to regulate power flow between a power source and a load.

16. The method of claim 15, further comprising:

producing a copper core structured to be inserted into the outer stem;

inserting the copper core into the outer stem before production of the outer stem is complete;

brazing the outer stem while the copper core is inserted into the outer stem; and removing the copper core from the outer stem after brazing is complete, wherein the copper from which the outer stem is produced is annealed, and wherein production of the outer stem is complete after brazing is complete.

17. The method of claim 16, further comprising:

forming the outer stem with stem threads on an interior surface of the outer stem;

forming each of the copper core and the aluminum core with core threads on an exterior surface of each of the copper core and the aluminum core;

inserting the copper core into the outer stem by screwing the copper core threads along the stem threads in a first direction;

removing the copper core from the outer stem by screwing the core threads along the stem threads in a second direction disposed opposite the first direction; and inserting the aluminum core into the outer stem by screwing the aluminum core threads along the stem threads in the first direction.

18. The method of claim 15, wherein the aluminum core is produced from aluminum alloy aluminum 7075.

* * * * *